United States Patent [19]

Sturdevant

[11] Patent Number: 4,639,577

[45] Date of Patent: Jan. 27, 1987

[54] ELECTRODES FOR ENHANCED HEAT AND MASS TRANSFER APPARATUS

[75] Inventor: Eugene J. Sturdevant, Berwyn, Pa.

[73] Assignee: Harry Hill Associates, Philadelphia, Pa.

[21] Appl. No.: 752,367

[22] Filed: Jul. 3, 1985

[51] Int. Cl.[4] ..... H05B 3/62; H01T 19/04

[52] U.S. Cl. ..... 219/399; 219/392; 361/230

[58] Field of Search ..... 219/399, 392, 402, 404, 219/10.81, 391, 394, 395, 396, 397, 398, 403, 280, 281; 165/1, 96; 174/16 R; 361/229, 230; 250/324, 325, 326; 264/22, 25, 26, 27; 422/186.04; 425/174.4, 0.6, 0.8 E, 0.8 R

[56] References Cited

U.S. PATENT DOCUMENTS

| | | | |
|---|---|---|---|
| 832,767 | 10/1906 | Bridge | 361/230 |
| 940,430 | 11/1909 | Chapman | 361/230 |
| 1,735,494 | 11/1929 | Chapman | 361/230 |
| 1,782,340 | 11/1930 | Chapman | 361/230 |
| 1,841,323 | 1/1932 | Chapman | 361/230 |
| 2,503,224 | 4/1950 | Trump | 361/230 |
| 2,866,923 | 12/1958 | Herbert | 361/230 |
| 3,551,743 | 12/1970 | Koepke | 361/230 |
| 4,344,104 | 8/1982 | Habets | 361/229 |

*Primary Examiner*—E. A. Goldberg
*Assistant Examiner*—Teresa J. Walberg
*Attorney, Agent, or Firm*—Dann, Dorfman, Herrell & Skillman

[57] ABSTRACT

In an electrical oven at least one corona generation electrode is provided to enhance heat and mass transfer. Food being cooked in the oven provides a second electrode which is normally supported on insulating support structure and provided with high potential through the use of a probe inserted into the food. A high voltage potential supply and constant current high voltage control are connected between the two electrodes. The corona generating electrode has a plurality of corona discharge generators with pointed or small diameter free ends fixed at their opposite ends to a common conductive base. The corona discharge generators are flexible and have current conducting capability and are connected to the conductive base so as to yield under pressure but to return to operative position upon imposition of corona producing potential. The corona discharge generators are preferably metallic foil, insulator sheet covered with foil or conductive fibers. It is desirable to provide internal resistance within the individual corona discharge generators by making them of somewhat resistive material, tipping them with resistive material or otherwise providing series resistance which will make it possible then for these flexible electrodes to be self-adjusting. Individual self-adjusting corona discharge generators withdraw from the other electrode to suppress an arc or various ones of them selectively withdraw to provide a profile conforming to the profile of the food constituting the other electrode even as it changes in the course of cooking.

16 Claims, 17 Drawing Figures

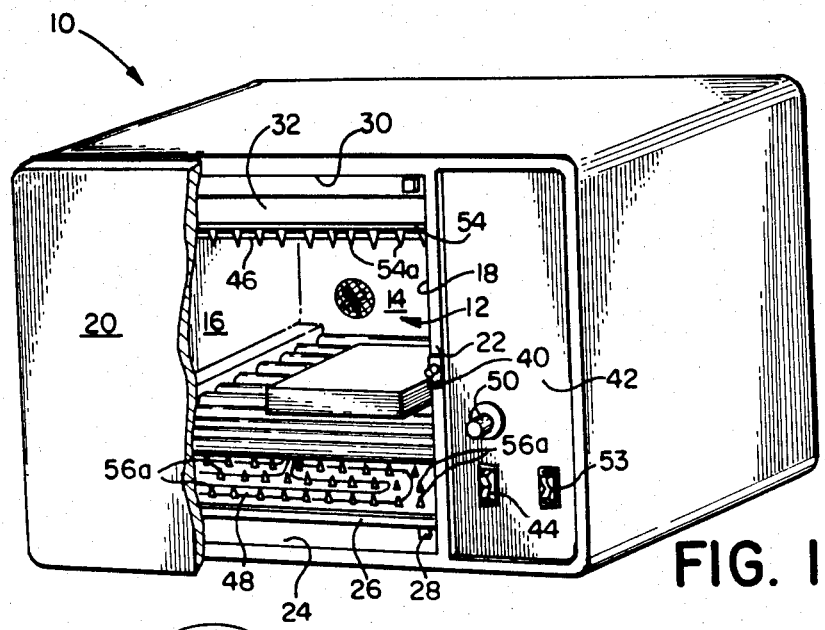
FIG. 1
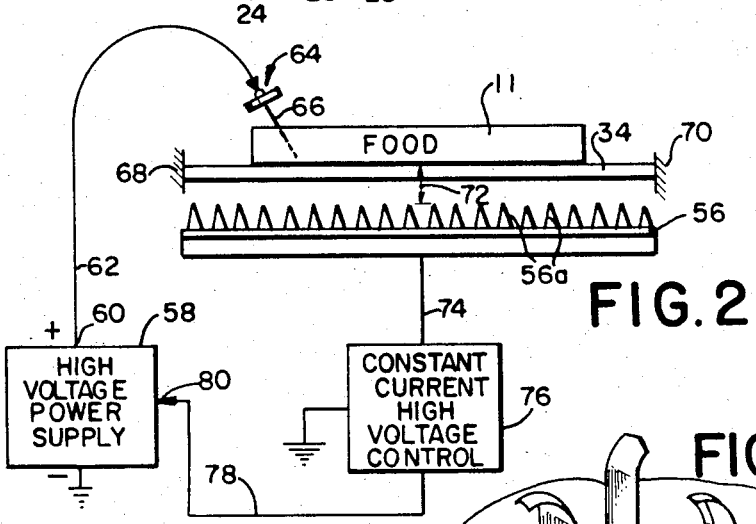
FIG. 2
FIG. 3b
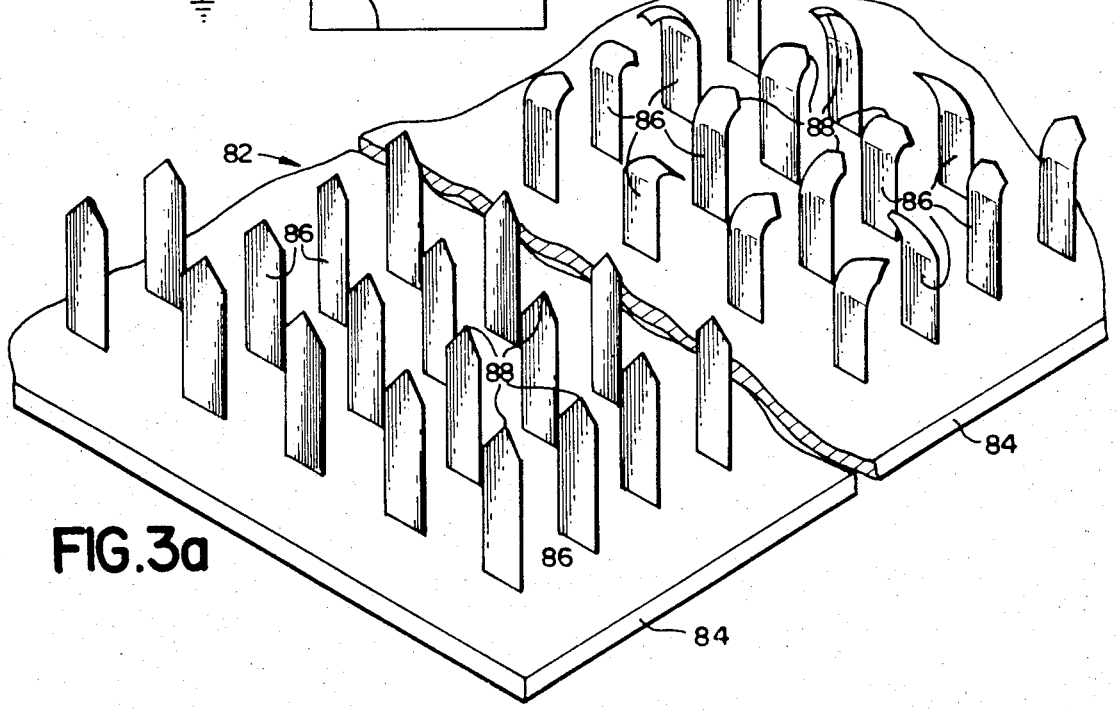
FIG. 3a

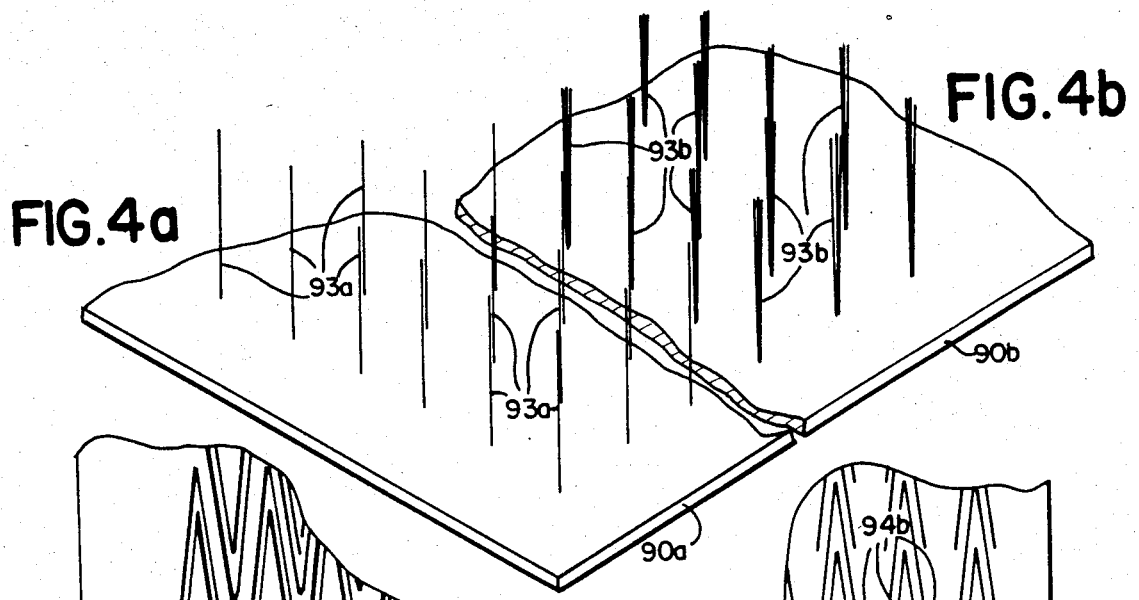
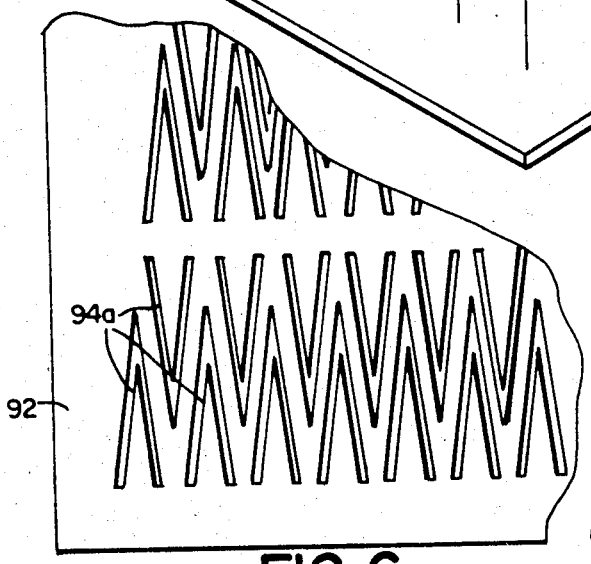
FIG.6
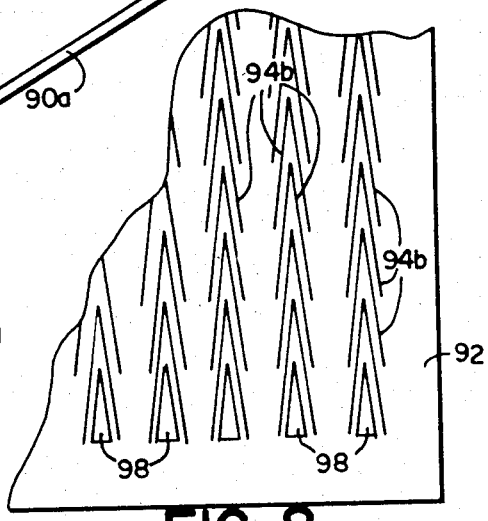
FIG. 8
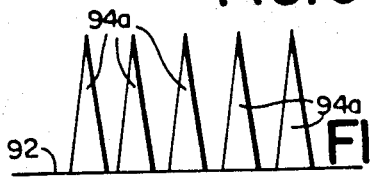
FIG.7a
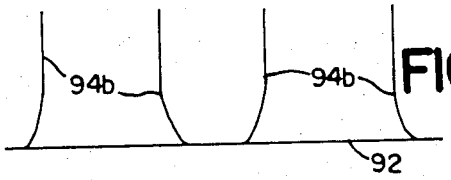
FIG.7b
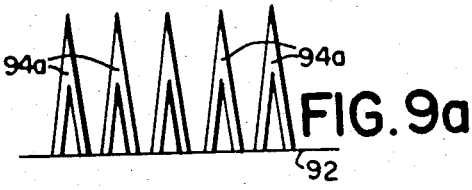
FIG.9a
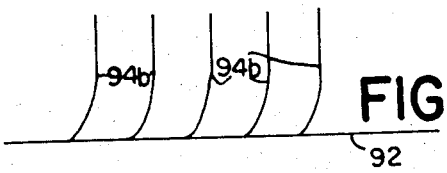
FIG.9b
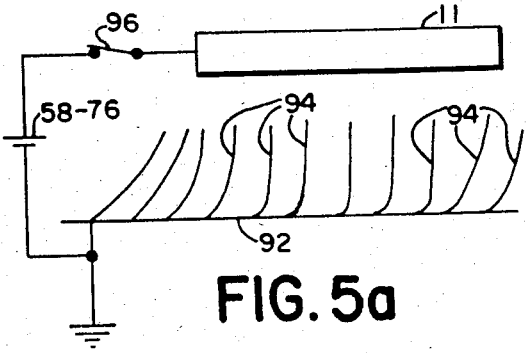
FIG.5a
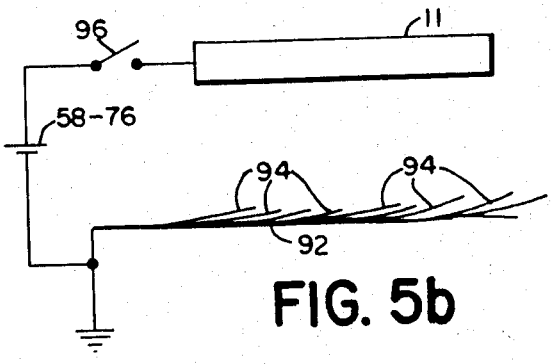
FIG. 5b

ELECTRODES FOR ENHANCED HEAT AND MASS TRANSFER APPARATUS

FIELD OF THE INVENTION

The present invention relates to an electrode configuration of a type for use in ovens or other enhanced heat and mass transfer apparatus. More specifically, the present invention relates to an improved electrode for use in a device of the type disclosed and claimed in U.S. Pat. No. 4,496,827. Electrodes of this type have been disclosed in other patents and applications of Eugene J. Sturdevant, specifically, U.S. Pat. Nos. 4,501,954, 4,523,082 and 4,558,208. In particular, the present invention has to do with the provision of a flexible electrode element for producing corona discharge.

BACKGROUND OF THE INVENTION

The above-identified applications and patents are the closest known prior art. The electrodes involved in such apparatus were described as needle electrodes and, in any event, were electrode elements of pointed or small diameter tip configurations with the electrodes fixed to a common base. It has been demonstrated that production of corona discharge for cooking and other heating applications is most efficiently accomplished by employing so-called "needle" electrode arrays for the active corona generator part of the electrode. However, when this is done various problems exist. The exposed pointed tips of the exposed needle electrodes are a potential source of injury to the user. The exposed needles are also subject to damage by the user which could reduce the electrode's effectiveness. Further, the needle electrode array in its support structure present a serious problem with regard to cleaning.

It is possible, of course, to devise mechanical means for preventing or making unlikely the injury of the user or the damage of the needles. It is even possible to reduce the cleanability problem somewhat. However, for solutions of this sort, complicated mechanisms which add cost to the unit are required. The cost is increased if the solution provided involves mechanical means which requires some sort of automatic actuation.

The present invention allows a solution to the aforementioned problem without mechanical additions which add expense or complication to the structure and without affecting the performance qualities of the device. In fact, the present invention permits reduction in cost.

The present invention provides a solution which retains all of the needed electrical qualities but eliminates the mechanical quality of rigidity which is primarily responsible for the difficulties described. In short, the active corona generator of the electrode device are designed to be mechanically flexible. While the elements remain pointed, the property of flexibility allows them to temporarily yield rather than either injuring the user or damaging something introduced by the user into the oven or else permanently bending in such a way as to reduce their effectiveness. The electrodes of the present invention, after yielding upon contact, are free to return to effective position and, moreover, are drawn by the electrostatic forces into effective position when in operation.

Additionally, the corona generators, in accordance with the present invention, are to an important extent self-adjusting. Because they are flexible, the corona generators are able to adjust individually to maintain common potential at the various electrode needles. For example, when food in a metal pan is introduced, those electrodes over the edge of the pan will receed. Even changes in the shape of food during cooking may cause a change in the "profile" of the corona generators such that different ones withdraw differing amounts corresponding to keep their distance above the food surface constant and uniform as baked goods rise, for example.

More specifically, the present invention relates to an improved electrode configuration for use in an oven for cooking food employing corona discharge as a means for enhancing heat and mass transfer. The electrode configuration employs a plurality of corona generators with pointed or small diameter free ends fixed to a common conductive sheet at their opposite ends to generate a corona discharge between that electrode and another body providing an electrode when a corona generating field is introduced between the electrodes. The improved electrode configuration comprises use of flexible electrodes having at least a metallic surface and connected to the conductive sheet so as to yield under pressure but return to operative position upon imposition of the corona producing field.

DESCRIPTION OF A PREFERRED ALTERNATE EMBODIMENTS OF THE INVENTION

For a better understanding of the present invention, reference is made to the accompanying drawings in which:

FIG. 1 is a perspective view of an oven employing the present invention;

FIG. 2 is a schematic view showing schematically in front elevation the corona generating electrodes with their corona generating circuit in a block diagram form;

FIG. 3*a* is a partial perspective view of part of the electrode configuration employing a plurality of corona discharge generators shown in field activated state;

FIG. 3*b* is a partial perspective view of another part of the same electrode in field deactivated state;

FIG. 4*a* is a view similar to FIG. 3*a* showing an alternative electrode configuration;

FIG. 4*b* is a view similar to FIG. 3*b* showing an alternative configuration to FIG. 4*a;*

Figure 10A:
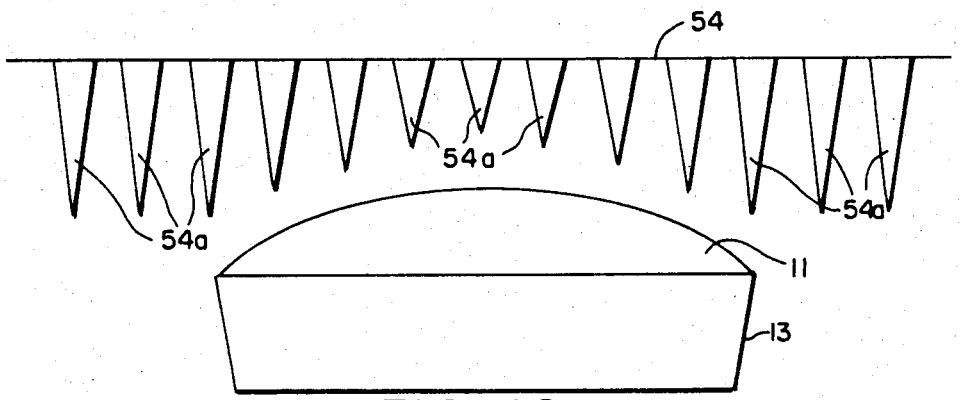
Figure 10B:
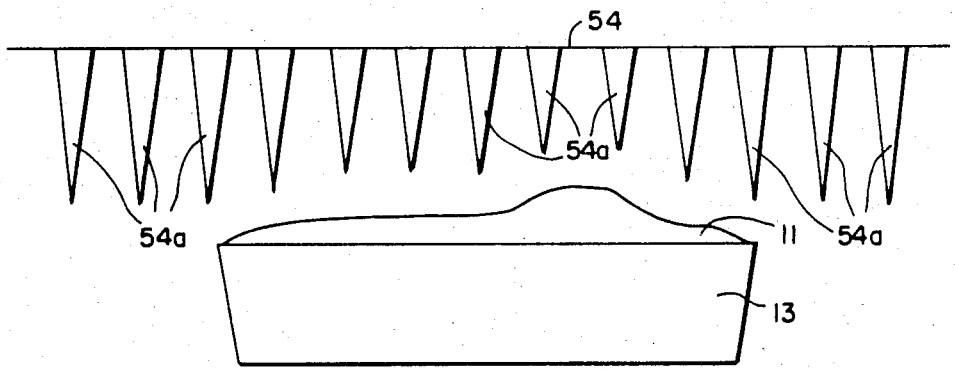
Figure 10C:
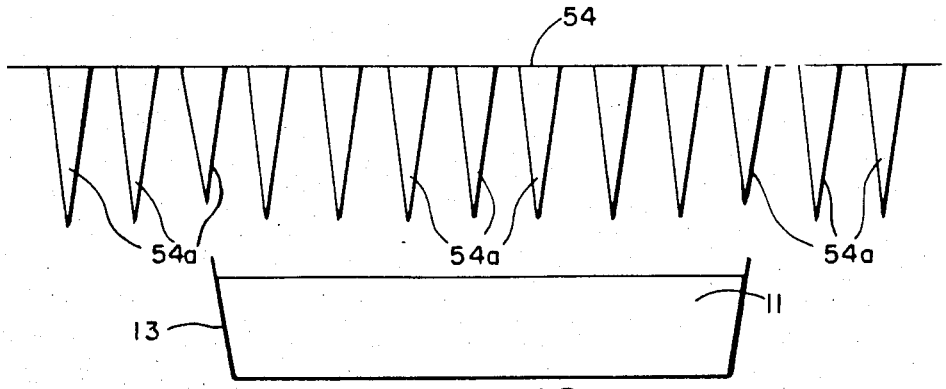

FIG. 5*a* is a schematic diagram representative of the system employing the electrodes of the present invention with a high voltage field on;

FIG. 5*b* is a similar view representative of the system with a high voltage field off;

FIG. 6 is a schematic view showing how electrodes can be cut, for example, from a foil sheet;

FIGS. 7*a* and 7*b* are front and side views respectively of the electrode arrangement of FIG. 6;

FIG. 8 is a modified electrode configuration cut from a sheet of foil or the like;

FIGS. 9*a* and 9*b* and the electrode configuration of FIG. 8 seen from the front and from the sides; and FIGS. 10*a* and 10*b* and 10*c* are diagramtic illustrations showing corona electrode self-adjustment in accordance with the present invention.

DETAILED DESCRIPTION OF THE PREFERRED EMBODIMENTS

With reference to the drawings, FIG. 1 shows a cooking device, preferably an oven 10 having embodied therein an apparatus constructed in accordance with the teaching of U.S. Pat. No. 4,496,827, in which the present invention can be employed. In general, oven 10 is built to house food 11 for cooking in a rectangular box shaped chamber 12. This chamber is defined in part by a back wall 14 adjoining spaced apart left and right walls 16 and 18. A fourth side wall is provided by a door 20 hinged relative to wall 16 for manual manipulation between an opened and closed position. The door 20 is shown in closed position but broken away to show the interior of the oven, and it will be understood that the door continues up to and overlaps edge 22 adjacent wall 18 to complete the closure. A bottom wall 24, in turn, supports a lower stationary plate 26 supported on a plurality of legs 28 attached to the bottom wall. The top wall 30 completes the chamber and supports a structure supporting and enabling movement of an upper plate 32. The nature of the movement of plate 32 is discussed in connection with U.S. Pat. No. 4,496,827 and does not materially effect the novel structure of the present invention. However, it will be understood that the plate 32 may be retracted to an upper most position approximately as shown in FIG. 1 or moved downward toward the food 11 in the course of use as described in the aforementioned patent. In any event, the boundaries of the cooking compartment are then defined by the back wall 14, the side walls 16 and 18 and the door 20 as well as the fixed plate 26 and the movable plate 32. It will, therefore, be understood that the actual cooking cavity size of chamber 12 is made to vary in accordance with the vertical positions of the movable plate 32.

A food supporting rack is provided by a plurality of insulator rods 34 which are spaced apart and supported horizontally by the side walls 16 and 18. These rods are spaced at a fixed distance above the lower plate 26 and normally closer to that plate than to plate 32 in its retracted position. The rods 34 may be made of a suitable insulating material having electrical isolation properties, such as a silica material. A door interlock switch 40 is mounted along the edge 22 of wall 18 to be contacted by the door and closed when it is closed. The switch is normally open when the door is opened and closed so that the circuit is energized when the door is shut. The switch performs a safety function preventing operation without the door being closed.

The oven is provided with a control panel 42 on which are located a switch 44 which provides electrical power to the system and the on/off switch for conventional upper heating element 46 and conventional lower heating element 48 which are used in conjunction with special electrodes of the present invention. Switch 53 controls power from the high voltage supply. A selector switch 50 is located adjacent the power switch 44 to selectively control the oven temperature. These conventional heating elements may be physically supported on the upper and lower plates 32 and 26 using standard insulation precautions. The upper electrode also requires a flexible connection to enable the electrode to be moved up and down. The dial 50 allows temperature selection in order to select a desired oven temperature. Selector switch 53 is an on/off EHT (enhanced heat transfer) selector switch is located adjacent the power switch and is operable to selectively control the main electrical power to operate the electrical circuitry of the system in which the present invention is employed.

The support plates 26 and 32 support electrodes 54 and 56 which include a plurality of corona generators in the form of pointed corona generator **54*a* and 56*a*** as will be discussed hereafter.

In FIG. 2, there is shown in schematic form an electrical circuit in connection with the lower electrode array 56. The electrical circuit includes a high voltage power supply 58 having a positive output terminal 60 electrically coupled to a output line 62. The high voltage power supply 58 is a constant current output d.c. positive high voltage supply whose output current from terminal 60 is both adjustable and regulated. The power supply 58 is operated from the usual household electric source (not shown) ranging between 105 and 135 volts a.c. and is made from known electrical components to impress a high voltage of between 3500 volts and 35,000 volts to the food. The electrical probe 64 has a conductive shaft 66 extending within the food 11. The conductive shaft 66 is electrically connected to the line 62 for communicating the electrical output from the terminal 60 of the high voltage power supply 58 to the food, so that the food becomes the high voltage electrode of the corona discharge system.

The food 11 is supported above the electrode 56 on a plurality of rods 34 rigidly attached to side walls 16 and 18 by suitable means 68 and 70. The rods 34 are made from electrically non-conductive material, such as silica or ceramic material so that the food 11 in chamber 12 is electrically isolated from the oven structure. Electrode 56 basically comprises a flat base plate 56 supporting a plurality of electrically conductive pointed corona generators **56*a*, sometimes referred to as "needle members". The pointed members may be of varying shape, but in order to produce suitable corona, need to have pointed or small diameter tips, hence the term "needle" electrode. Those elements 56*a* directly beneath the food 11 define a current supporting electrical field which crosses the gap generally designated 72 between the corona generators and the food as the high voltage electrode. A line 74 is electrically coupled to the sheet 56 of the low voltage electrode and collects and communicates the total conductive current from the corona generators to a constant current high voltage control unit 76. A line 78 extends from the current high voltage control unit 76 to the control terminal 80 of high voltage power supply 58**.

In operation, the high voltage is supplied from the high voltage power supply 58 to the food through line 62 and the conductive shaft 66 of the probe 64. The actual voltage supplied to the food 11 varies and is regulated in the electrical circuit so as to maintain the optimum current flow in electrical field 72. The voltage necessary to produce optimum corona current depends on factors such as oven temperature, the gap distance of the electrical field, separating the tips of electrode elements **56*a* from the bottom surface of food 11, and the dielectric properties resisting current flow in the electrical field 72. Electrode 56 is operated at close to ground potential and conducts current as a result of the voltage supplied to the food 11 through the electrical field 72 to the tips 56*a* of the corona generators located beneath the food. The conducted current at the tips is normally sufficient to cause the tips to generate corona current through the electrical field 72 to the food surface 11 for enhancing heat and mass transfer at the surface of the food. According to U.S. Pat. No. 4,496,827, each corona generator 56*a* is operating to conduct 6.25 microapmperes to generate optimum corona current. The total conducted current from the corona generators 56*a* is supplied on line 74 to the constant current high voltage control 76 which is operated according to the disclosure of said patent to generate a signal on line 78 to the high voltage power supply 58. The signal appearing on line 78 is representative of the conducted current on line 74. With respect to the current necessary to produce optimum corona current density (25 muA/in.$^2$), an electrical field 72 is utilized in the high voltage power supply 58** to regulate the voltage output to the food for delivering the voltage necessary for maintaining optimum corona current density.

The present invention is directed to the use of flexible corona generators to replace the rigid needle electrodes of the prior art. These electrodes may take various forms or shape, but the rigid needle elements are preferably replaced by flexible corona generator members. The corona generator members may be composed of conductive foil, such as aluminum or phospher bronze, preferably with internal or series resistance added and provided with a suitable pointed tip, or of filaments or strands of conductive material. Inclusion of sufficient resistance is important to most efficient operation and the ability to be self-adjusting, as will be discussed hereafter. In either form, the electrodes may either be completely metallic with resistance added or they may be metallic coating on a non-metallic base, even an insulator material such as Mylar ® or Capton ®. If metalized non-conductive film is used for example, resistance added metalization may be on both sides or only on one side.

FIGS. 3*a* and 3*b* show an embodiment of the present invention wherein a portion of an electrode 82 is shown. The electrode consists of a metallic base 84 which has been broken. FIG. 3*a* represents a part of the electrode in active state; FIG. 3*b* represents another part in active state. In any event, to the metallic plate or sheet 84 are attached a plurality of strips of foil 86 each terminating in a pointed end opposite the end of the attachment to the base plate 84. As will be seen in FIG. 3, when the device is in operation so that voltage is applied, the electrode elements 86 will straighten up and be directed toward the food 11. At other times, when there are no electrostatic forces in play, the electrodes tend to droop because they are light foil or film material. In any event, should they be brushed or bumped in the course of use of the oven, no damage will occur because they will yield to the pressure and can collapse even further than shown in FIG. 3*b*. Thereafter, when the field is applied, they will return to the position shown in FIG. 3*a*.

It will be understood that the material used for the strips may be flexible yet relatively self-supporting, in which event the corona generator when deactivated may still appear as they do in FIG. 3*a*. Such electrodes still have advantage because they are sufficiently flexible to bend when pushed or bumped but restore themselves to proper position when the corona field is applied.

FIGS. 4*a* and 4*b* show flexible fibers as corona generators. In each case, the filaments may be pure metallic wire, but, in most instances, they would be flexible fibers, synthetic or otherwise, preferably coated with conductive resistance material, metal or carbon to be conductive. In FIG. 4*a* the portion of conductive base 90*a* is provided with coated flexible single filaments 93*a* preferably placed in a regular array on the base. Such fibers are of sufficiently small diameter that they are needle-like without actually being physically pointed and, therefore, capable of generating corona.

Similarly, in addition to single fibers, it is possible as shown in FIG. 4*b* to apply tufts of several fibers 93*b* to a base 90*b*, each of which is individually conductively coated. These corona generators may be formed of fibers such as glass or polymers such as Kevlar ® or even fine metal wire.

Of course, in either type of application the selection of film or fiber will depend upon the temperature range to which that material will be exposed in the oven in a particular application. Physical characteristics such as thickness and flexibility of film or fiber pieces are chosen so that the pieces will perform satisfactorily as corona source yet will flex to prevent injury and so as not to be damaged themselves when physically contacted.

FIGS. 5*a* and 5*b* represent still another alternative form of electrode wherein the corona generator or needle elements are formed by cutting the corona generators 94 out of the base 92 of foil or metalized films, preferably films loaded with carbon or cer-met particles to be individually of high resistance value to preserve the self-adjusting feature. Various specific forms of electrodes are shown in FIGS. 6 through 9*b*. Such sheets can be lanced in one operation directly out of a sized sheet of selected material. Alternatively, the sheets may be lanced by a rotating die while in a continuous roll and later cut to size. In either event, the lanced elements are formed to have points at their ends remote from the point of attachment to the sheets and are left attached to the material at their bases to avoid need for separate attachment of the corona generators 94 to the base. The same lancing gives the corona generators their shape and different shapes may be selected in accordance with the perceived needs of particular electrode geometry including the effect of the electrostatic field on the individual corona generators. Where resistive material is used, the shape of the corona generator also enables selective distribution of resistance.

The manufacturing process may even crease the corona generators 94 at their bases so that each electrode element physically is essentially no different from one wherein film or foil strips are mechanically fixed or cemented to a support plate. However, no crease to simulate a hinge permitting a sharp vertical orientation of the electrode in a plane is required. If the film or foil is limp enough, the lanced segments providing the corona generators will lift to change their orientation toward the food 11 providing the passive electrode of the system under the influence of the high voltage field. Flexibility of individual corona generator elements is also subject to design to provide greater or lesser compliance to field forces. This arrangement is illustrated in FIGS. 5*a* and 5*b*. In FIG. 5*a*, the power source is represented schematically as a battery symbol 58–76. When cut off by the equivalent of switch 96 in FIG. 5*b* allows the corona generators 94 to flatten out essentially into the plane of the base 92. However, when switch 96 is closed imposing on the electrostatic field, the electrode elements are drawn toward the positive electrode and move into a position somewhat like that simulated in FIG. 5*a*.

FIGS. 6 and 8 show alternative examples of the many different kinds of possible electrodes that can be formed. These are triangular types, the difference being that in FIG. 6 alternative rows are reversed and interspersed so that more corona generators can be produced on a single sheet.

Electrodes of these types have the advantage that they are flat and that they lend themselves to cleaning in a single plane when not activated. Furthermore, the ease with which such electrodes can be made facilitates their being used as throwaways. The fact that they are made of light material, either of foil or a metalized film enables the cost of materials to be kept at a minimum where the possibility of periodically discarding the whole electrode becomes a practical consideration.

FIG. 6 as previously mentioned shows a foil or metalized film base out of which are cut triangular current generators 94*a* which in alternate rows are reversed. The effect of this is shown by observation of FIG. 7*a* which shows a front elevation when the system is activated and FIG. 7*b* a side elevation. The corona generators are shown as having double Vs cut in them. Whether the double V or only a single V is cut practically makes little difference. The double V has the advantage that the mass of the individual electrode is somewhat reduced, but as a practical matter, both pieces will probably be drawn up together when the system is energized as shown in FIG. 5*a*.

FIG. 8 shows a system in which all generators 94*b* are cut in the same direction from the base 92*b* of foil or metalized film. The effect upon energization, the condition of FIG. 5*a*, is shown in FIGS. 9*a* and 9*b* which show front and side views of the electrode. It will be observed that a cut out portion is removed in this case so that all of the current generators will be of the same mass.

Since arc suppression is important in corona generation and is most effectively applied if provided at each corona discharge location, means of accomplishment completely set the "flexible" electrode apart in superiority. Particularly among the candidate materials comprising plastic films and plastic or glass fibers, accomplishment of arc suppression is simple and direct: additive materials with appropriate electrical and temperature properties whose controlled dispersion into the forming glass or plastic can cause the base material to become conductive enough to serve as a high voltage resistance. Typically, each strip or segment should have a resistance to current flow of the order of 10% of the resistance of the immersion gas through which the corona discharge current must flow to reach the passive electrode. In air at room temperature and at a separation between active and passive electrodes of 1 cm, electrical resistance of the immersion gas above each corona discharge point is approximately 1000 Megohms ($1 \times 10^9$ ohms) so that the resistance through the film to each point should be of the order of 100 Megohms ($1 \times 10^8$ ohms). This value isolates each point fromm the high voltage supply as well as from all other points on the electrode so that arcing tendencies are suppressed and corona currents from all the points tend to equalize.

The flexible electrode that utilizes the electrical field strength of the high voltage field to lift and orient the discharging points exhibits an additional capability in arc suppression and current equalization. For example, if each discharge point is desired to supply 5 microamperes corona current and the corona threshold voltage is 3500 volts, 9000 volts potential will be required from the high voltage supply to force this current through the circuit: 3500 volts to overcome the corona threshold, 500 volts will be dropped by the suppression resistor, and 5000 volts will be required to propel the ions of the corona current across the gas gap to the passive electrode. Should, for some reason, the discharge current from a single electrode point tend to increase as it would when an arc tries to form, i.e., 10 microamperes flows from one point, 1000 volts is dropped across that suppression resistor, 3500 volts is still required to establish threshold leaving 4500 volts to drive ions across the gap. Note that the coulomb attractive force due to 4500 volts is 10% less than that due to the 5000 volts maintained by surrounding points so that the high current point relaxes to a greater separation distance from the opposite electrode increasing the electrical resistance of the gap in adding to the effect of a reduced ion driving potential across the gap. In the opposite case, should nonuniformity within the film or external effects tend to cause a point to discharge less than desired current, the point will rise toward the passive electrode due to increased force induced by higher field strength reducing electrode separation giving rise to its discharge current.

It should be noted that polymer materials (organic compounds) when directly exposed to corona discharge erode away. This effect is eliminated if at the point of discharge another material is used to support and contact the discharge, such as 100% metalization or other covering. Metal particle loaded cements, such as high temperature epoxies or ceramic adhesives may also be used. The ends of the corona generators dipped in such resistive material, for example, may provide the desirable resistance while protecting the support material. The effect of the appropriate selection is to greatly extend corona generator life and preserve its effectiveness since the low corona threshold voltage and discharge efficiency is dependent upon the sharpness of the discharge point.

Due to interdependence of corona generator R, force constants, local field strength and separation distance, the flexible electrode can accommodate irregular food surfaces, i.e., food changing shape during cooking; food normally not presenting a flat surface or food in a metallic container with high walls.

FIGures 1O*a*, 1O*b* and 1O*c* illustrate another advantage of the flexible electrodes of the present invention. There is an interdependence of the corona generator resistances, force constants, local field strengths and separate distance from the food. The flexible electrode can accommodate to irregular surfaces which occur for various reasons. FIG. 10*a* illustrates the common situation of a cake or other pastry rising in a cake pan 13 and shows that the corona generators 54*a* will yield in varying amounts to adjust to the new shape of the food 11 as it occurs and will actually conform to a large extent to that same surface contour. In some cases, the food may not rise uniformally, as shown in FIG. 10*b*, and the electrodes can accommodate to even local changes in food surface contour. Furthermore, as illustrated in FIG. 10*c*, even the situation where the contents of a pan are well below the edges can be accommodated because the electrodes over the edges of the pan will simply recede, if the balance of resistance and other effects in the system is properly designed. This self-adjusting feature is unique to the various flexible electrodes of the present invention.

The present invention has been described in terms of a number of embodiments and other embodiments and variations will occur to those skilled in the art. All such embodiments and variations within the scope of the claims are intended to be within the scope and spirit of the present invention.

I claim:

1. An improved corona generation electrode configuration for use in a device for enhancing heat and mass transfer, employing corona discharge, wherein the corona generation electrode and another body providing a second electrode are able to produce corona discharges between them, comprising providing said corona generation electrode with a plurality of corona discharge generators with pointed or small diameter free ends fixed at their opposite ends to a common conductive base wherein the corona generation electrode employs a plurality of flexible self-adjusting corona discharge generators having at least a current conducting capability and each of which is connected to the conductive base so as to yield under mechanical pressure but return to operative position upon imposition of a corona producing potential and to individually yield to varying electrostatic forces during operation.

2. The corona generation electrode of claim 1 in which the corona discharge generators consist of electrode strips of conductive sheet material with pointed ends.

3. The corona generation electrode of claim 2 in which each of the corona generation electrodes is fixed to the common conductive base by a separate junction.

4. The corona generation electrode of claim 2 in which the corona discharge generators are formed by cutting them out of the common conductive sheet which provides the base.

5. The corona generation electrode of claim 4 in which the common conductive sheet is a metal tipped resistive material.

6. The corona generation electrode of claim 1 in which the corona discharge generators are flexible fibers.

7. The corona generating electrode of claims 1, 2, 5 or 6 in which the flexible corona discharge generators are tipped with resistive material.

8. The corona generation electrode of claim 6 in which the flexible fibers are attached to the base in a regular pattern.

9. The corona generation electrode of claim 6 in which the flexible fibers are attached as tufts or groups in a pattern to the base.

10. The corona generation electrode of claim 6 in which the flexible fibers are metal tipped resistive members.

11. The corona generation electrode of claim 1 in which the flexible corona discharge generators are formed of resistance particle loaded film.

12. The corona generating electrode of claim 1 in which the flexible corona discharge generators are formed of resistance particle loaded fibers.

13. The corona generating electrode of claims 1, 2, 5 or 6 in which the flexible corona discharge generators are tipped with conductive material loaded epoxies.

14. In an oven including a corona generating electrode configuration in accordance with claim 1, probe means to be inserted into food and high voltage generation means connected between them and in which the flexible corona discharge generators are provided with sufficient resistance as to be self-adjusting.

15. The system in accordance with claim 14 in which the electrodes will self adjust upon the occurrence of an arc such that the flexible corona discharge generators will withdraw from the food surface to suppress the arc.

16. The system of claim 14 in which the plurality of flexible corona discharge generators will selectively adjust their spacing from the surface of food or metal containers providing part of the other electrode in order to provide essentially uniform spacing between the tips of the corona discharge generators and the other electrode.

* * * * *